US011170755B2

(12) United States Patent
Lee et al.

(10) Patent No.: US 11,170,755 B2
(45) Date of Patent: Nov. 9, 2021

(54) SPEECH SYNTHESIS APPARATUS AND METHOD

(71) Applicant: SK TELECOM CO., LTD., Seoul (KR)

(72) Inventors: Changheon Lee, Seoul (KR); Jongjin Kim, Seoul (KR); Jihoon Park, Seoul (KR)

(73) Assignee: SK TELECOM CO., LTD., Seoul (KR)

( * ) Notice: Subject to any disclaimer, the term of this patent is extended or adjusted under 35 U.S.C. 154(b) by 0 days.

(21) Appl. No.: 16/863,138

(22) Filed: Apr. 30, 2020

(65) Prior Publication Data

US 2020/0335080 A1 Oct. 22, 2020

Related U.S. Application Data

(63) Continuation of application No. PCT/KR2018/012967, filed on Oct. 30, 2018.

(30) Foreign Application Priority Data

Oct. 31, 2017 (KR) ..... 10-2017-0143286

(51) Int. Cl.

| | |
|---|---|
| ***G10L 13/06*** | (2013.01) |
| ***G10L 13/00*** | (2006.01) |
| ***G10L 13/047*** | (2013.01) |
| ***G10L 13/10*** | (2013.01) |

(52) U.S. Cl.
CPC ..... *G10L 13/047* (2013.01); *G10L 13/10* (2013.01)

(58) Field of Classification Search
CPC ..... G10L 13/06; G10L 13/047
See application file for complete search history.

(56) References Cited

U.S. PATENT DOCUMENTS

| | | | | |
|---|---|---|---|---|
| 2002/0103646 | A1* | 8/2002 | Kochanski | G10L 13/047 704/260 |
| 2006/0229877 | A1* | 10/2006 | Tian | G10L 13/06 704/267 |
| 2006/0235692 | A1* | 10/2006 | Mukhtar | G10L 19/0018 704/260 |
| 2007/0106513 | A1* | 5/2007 | Boillot | G10L 13/06 704/260 |
| 2020/0335080 | A1* | 10/2020 | Lee | G10L 13/0335 |

FOREIGN PATENT DOCUMENTS

| | | | |
|---|---|---|---|
| JP | 10-91183 | A | 4/1998 |
| KR | 10-2003-0035522 | A | 5/2003 |
| KR | 10-2004-0070505 | A | 8/2004 |
| KR | 10-2005-0088705 | A | 9/2005 |
| KR | 10-2006-0008330 | A | 1/2006 |
| KR | 10-1056567 | B1 | 8/2011 |

OTHER PUBLICATIONS

International Search Report dated Jan. 29, 2019, in connection with corresponding International Patent Application No. PCT/KR2018/012967, citing the above references with English translation.

* cited by examiner

*Primary Examiner* — Shreyans A Patel
(74) *Attorney, Agent, or Firm* — Hauptman Ham, LLP

(57) ABSTRACT

The present disclosure relates to a speech synthesis apparatus and method that can remove discontinuity between phoneme units when generating a synthesized sound from the phoneme units, thereby implementing natural utterances and producing a high-quality synthesized sound having stable prosody.

11 Claims, 8 Drawing Sheets

SPEECH SYNTHESIS APPARATUS AND METHOD

CROSS-REFERENCE TO RELATED APPLICATIONS

The present application is a continuation of International Patent Application No. PCT/KR2018/012967, filed on Oct. 30, 2018, which is based upon and claims the benefit of priority to Korean Patent Application No. 10-2017-0143286, filed on Oct. 31, 2017. The disclosures of the above-listed applications are hereby incorporated by reference herein in their entirety.

TECHNICAL FIELD

The present disclosure relates to a speech synthesis technique and, more particularly, to a speech synthesis apparatus and method for outputting a text input as a speech.

BACKGROUND ART

Generally, a text to speech (TTS) system refers to a system that receives a text input of a sentence and outputs the inputted sentence in the form of speech. The operation process of the speech synthesis system is divided into a training process and a synthesis process. The training process refers to a process of creating a language model, a prosody model, and a signal model which will be used in the synthesis process. The synthesis process refers to a process of generating a synthesized sound by sequentially performing language processing, prosody processing, and signal processing on inputted text, based on corresponding models.

As synthesis methods used in the synthesis process, there are a unit selection synthesis (USS) method which is a unit-based synthesis technique, and a statistical parametric synthesis (SPS) method which is a statistical model-based parametric synthesis technique.

The USS method is a technique of determining suitable phoneme units from a phoneme database that contains several unit candidates per phoneme, and combining the determined phoneme units to generate a synthesized sound. However, the USS method has a problem in that there is discontinuity between phoneme units and utterances are unnatural.

On the other hand, the SPS method is a technique of modeling parameters extracted from a speech signal in the training process and generating a synthesized sound by using a parametric model and an input sentence in the synthesis process. Although the SPS method can generate a synthesized sound having a stable prosody than the USS method, there is a problem in that a basic sound quality is low.

SUMMARY

Accordingly, the present disclosure is to provide a speech synthesis apparatus and method capable of removing discontinuity between phoneme units, realizing natural utterances, and generating a high-quality synthesized sound having a stable prosody.

According to an embodiment of the present disclosure, a speech synthesis apparatus may include a phoneme database storing a plurality of phoneme units including one or more candidate units per phoneme; a prosody processor analyzing prosody information on an inputted text and thereby predicting a target prosody parameter of a target phoneme unit;

a unit selector selecting a specific phoneme unit from among the one or more candidate units per phoneme stored in the phoneme database, based on the prosody information analyzed by the prosody processor; a prosody adjuster adjusting a prosody parameter of the specific phoneme unit selected by the unit selector to be the target prosody parameter of the target phoneme unit predicted by the prosody processor; and a speech synthesizer generating a synthesized sound by removing discontinuity between the specific phoneme units each having the prosody parameter adjusted by the prosody adjuster.

The plurality of phoneme units stored in the phoneme database may be constructed in a form of voice waveforms or in a form of parameter sets.

The prosody parameter may include at least one of a fundamental frequency, an energy, or a signal duration.

The prosody adjuster may adjust a signal duration of the selected phoneme unit to be a signal duration of the target phoneme unit, and then adjust a fundamental frequency and energy of the selected phoneme unit to be a fundamental frequency and energy of the target phoneme unit, respectively.

In addition, the prosody adjuster may copy or delete some of frames constituting the selected phoneme unit such that the signal duration of the selected phoneme unit is the signal duration of the target phoneme unit.

In addition, the prosody adjuster may convert frame indexes of the selected phoneme unit into new frame indexes by using Equation below, and adjust the signal duration of the selected phoneme unit to be the signal duration of the target phoneme unit by copying or deleting some of frames constituting the selected phoneme unit in accordance with the new frame indexes.

$$r\left(\frac{N-1}{M-1}i\right)$$

(in the above Equation, 'M' denotes the total number of frames of the target phoneme unit, 'N' denotes the total number of frames of the selected phoneme unit, T denotes a frame index of the selected phoneme unit, and 'r' denotes a rounding-off operation)

In addition, the speech synthesizer may identify a prosody parameter of a last frame of a previous phoneme unit and a prosody parameter of a start frame of a next phoneme unit from among the specific phoneme units having the prosody parameters adjusted by the prosody adjuster, calculate an average value of the identified prosody parameters, and remove the discontinuity by applying the calculated average value to each of the last frame and the start frame or by applying the calculated average value to a frame produced by overlapping the last frame and the start frame.

According to an embodiment of the present disclosure, a speech synthesis method, performed by a speech synthesis apparatus including a phoneme database storing a plurality of phoneme units including one or more candidate units per phoneme, may include analyzing prosody information on an inputted text to thereby predict a target prosody parameter of a target phoneme unit; selecting a specific phoneme unit from among the one or more candidate units per phoneme stored in the phoneme database, based on the analyzed prosody information; adjusting a prosody parameter of the selected specific phoneme unit to be the target prosody parameter of the target phoneme unit; and generating a synthesized sound by removing discontinuity between the specific phoneme units each having the adjusted prosody parameter.

The adjusting may include adjusting a signal duration of the selected phoneme unit to be a signal duration of the target phoneme unit; and then adjusting a fundamental frequency and energy of the selected phoneme unit to be a fundamental frequency and energy of the target phoneme unit, respectively.

In addition, the adjusting may include converting frame indexes of the selected phoneme unit into new frame indexes by using Equation below, and adjusting the signal duration of the selected phoneme unit to be the signal duration of the target phoneme unit by copying or deleting some of frames constituting the selected phoneme unit in accordance with the new frame indexes.

$$r\left(\frac{N-1}{M-1}i\right)$$

(in the above Equation, 'M' denotes the total number of frames of the target phoneme unit, 'N' denotes the total number of frames of the selected phoneme unit, T denotes a frame index of the selected phoneme unit, and 'r' denotes a rounding-off operation)

In addition, the generating may include identifying a prosody parameter of a last frame of a previous phoneme unit and a prosody parameter of a start frame of a next phoneme unit from among the specific phoneme units having the adjusted prosody parameters; calculating an average value of the identified prosody parameters; and removing the discontinuity by applying the calculated average value to each of the last frame and the start frame or by applying the calculated average value to a frame produced by overlapping the last frame and the start frame.

Further, the present disclosure may provide a non-transitory computer-readable recording medium that stores a program for executing the above method.

The speech synthesis apparatus and method according to an embodiment of the present disclosure can realize natural utterances by removing discontinuity between phoneme units when generating a synthesized sound from phoneme units, and also generate a high-quality synthesized sound having a stable prosody.

In addition, the present disclosure can remove the discontinuity and generate the high-quality synthesized sound even in a situation of failing to find an optimal candidate of phoneme unit.

DETAILED DESCRIPTION

Figure 1:
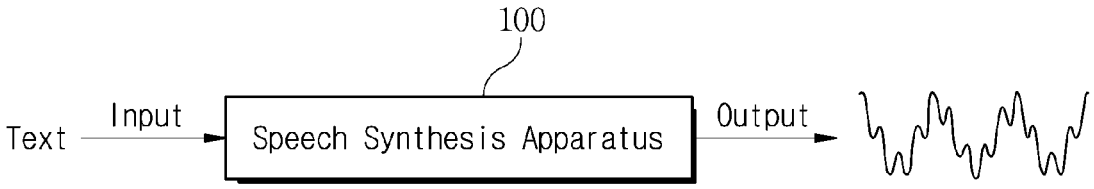
FIG. 1 is a conceptual diagram schematically illustrating a speech synthesis process.

Hereinafter, embodiments of the present disclosure will be described in detail with reference to the accompanying drawings.

The present disclosure may be embodied in various forms and should not be construed as being limited to the embodiments disclosed herein. The disclosed embodiments are provided to fully convey the scope of the present disclosure to those skilled in the art. The principles and features of the disclosure may be applied in a wide variety of embodiments without departing from the scope of the disclosure.

In addition, in describing the embodiments, techniques that are well known in the technical field to which the present disclosure pertains or are not directly related to the present disclosure may not be described or illustrated in detail to avoid obscuring the subject matter of the present disclosure. Like reference numerals refer to like or corresponding elements throughout the accompanying drawings.

Also, the terms used herein are only for describing particular embodiments of this disclosure and do not limit such embodiments. Singular forms are intended to include plural forms unless the context clearly indicates otherwise. The terms "comprise", "include", "have" and the like used herein are intended to merely indicate that the features, numbers, steps, operations, components, parts, or combinations thereof described herein are present, and not intended to exclude any possibility that other non-described features, numbers, steps, operations, components, parts, or combinations thereof may be present or added.

At the outset, the concept of a speech synthesis process will be described with reference to FIG. 1. FIG. 1 is a conceptual diagram schematically illustrating a speech synthesis process.

As shown in FIG. 1, a speech synthesis apparatus 100 refers to a speech synthesis system that receives a text input of a sentence and outputs the inputted sentence in the form of speech.

In particular, the speech synthesis apparatus 100 analyzes prosody information on an inputted text to predict a target prosody parameter of a target phoneme unit, selects a specific phoneme unit from among one or more candidate units per phoneme stored in a phoneme database, based on the analyzed prosody information, adjusts a prosody parameter of the selected specific phoneme unit to be the target prosody parameter of the target phoneme unit, and generates a synthesized sound by removing discontinuity between the specific phoneme units with the prosody parameter adjusted.

The speech synthesis apparatus 100 may be applied to an automatic response service (ARS) system for various financial services such as banks, securities, insurance, and cards, and also applied to various services that read a designated text and offer it to the user in the form of voice, such as a voice portal service guiding web pages by voice, an integrated messaging system supporting a voice message transmission function, and an educational voice solution system.

In addition, the speech synthesis apparatus 100 may be combined with a speech recognition apparatus (not shown) to construct a speech system. In this case, when the speech recognition apparatus (not shown) recognizes a user's speech and constructs a response text, the speech synthesis apparatus 100 may output the response text in the form of a synthesized sound. A representative example of such a voice system is an artificial intelligence speaker.

Besides, the speech synthesis apparatus 100 may be employed in various services that support an output of a synthesis sound, while being equipped in a user terminal (not shown) or implemented in the form of a server. When implemented in the form of a server, it may also support a process of providing the synthesis sound to the user terminal (not shown) via a communication network (not shown).

Now, elements and operations of the speech synthesis apparatus 100 according to an embodiment of the present disclosure will be described in detail.

Figure 2:
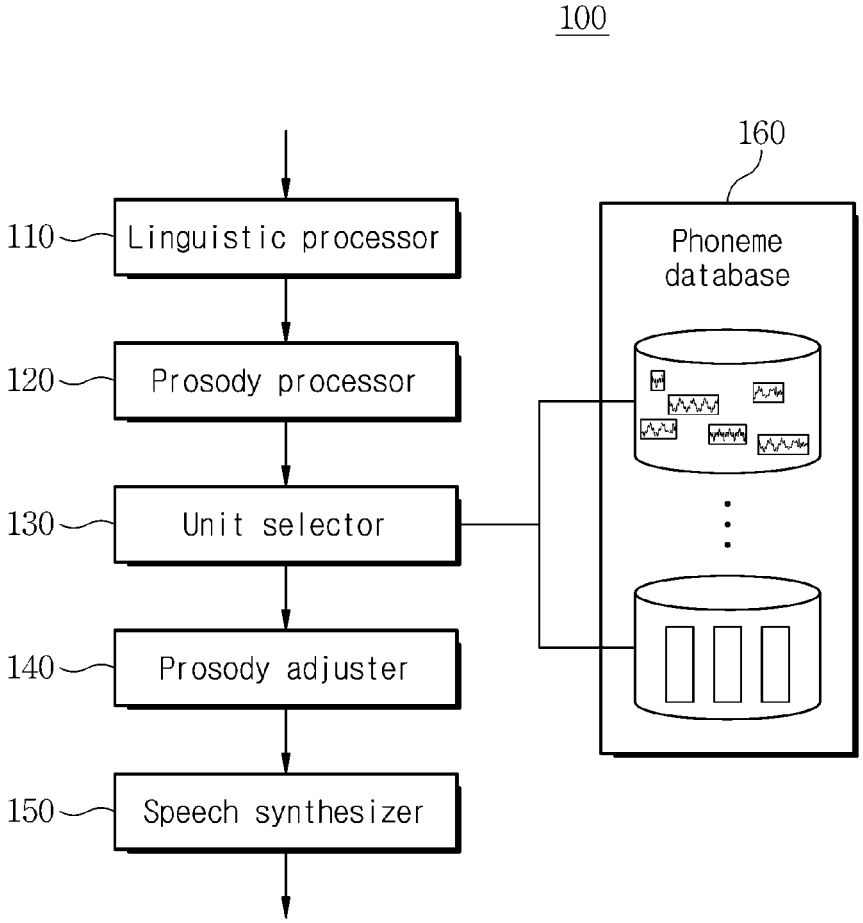
FIG. 2 is a block diagram illustrating elements of a speech synthesis apparatus according to an embodiment of the present disclosure.

FIG. 2 is a block diagram illustrating elements of a speech synthesis apparatus according to an embodiment of the present disclosure.

Referring to FIG. 2, the speech synthesis apparatus 100 includes a linguistic processor 110, a prosody processor 120, a unit selector 130, a prosody adjuster 140, a speech synthesizer 150, and a phoneme database 160.

The phoneme database 160 stores a plurality of phoneme units. The phoneme units include one or more candidate units per phoneme. The plurality of phoneme units stored in the phoneme database 160 may be constructed in the form of voice waveforms or in the form of parameter sets.

When any sentence is inputted in the form of text, the linguistic processor 110 performs language analysis and processing on the inputted text. Specifically, the linguistic processor 110 performs syntax analysis and morpheme analysis on the inputted text and thereby obtains information on a sentence structure and a sentence type. In addition, the linguistic processor 110 translates a letter of a language other than a specific language, contained in the sentence, into a letter of the specific language, and also predicts an actual pronunciation of the inputted text. The output of the linguistic processor 110 is used as an input of the prosody processor 120.

The prosody processor 120 analyzes and processes prosody information on the text inputted through the linguistic processor 110. Specifically, the prosody processor 120 may analyze the prosody information such as intonation and accent according to the sentence structure and type, such as determining a part to be read with a pause in a sentence, a part to be read strongly, and a tone of a sentence ending. In addition, the prosody processor 120 determines a target phoneme unit predicted based on the analyzed prosody information, and predicts a prosody parameter (i.e., a target prosody parameter) of the determined target phoneme unit. The prosody parameter may be a fundamental frequency (or pitch period), an energy, a signal duration, and/or the like.

The unit selector 130 selects a specific phoneme unit from among one or more candidate units per phoneme stored in the phoneme database 160, based on the prosody information analyzed by the prosody processor 120. That is, the phoneme database 160 may store several candidate units for each phoneme, and the unit selector 130 selects, based on the analyzed prosody information, a suitable phoneme unit from among the stored candidate units for each phoneme.

The prosody adjuster 140 adjusts a prosody parameter of the specific phoneme unit selected by the unit selector 130 to be the target prosody parameter of the target phoneme unit predicted by the prosody processor 120. As mentioned above, the prosody parameter is a fundamental frequency, an energy, a signal duration, and/or the like. In particular, the prosody adjuster 140 may adjust the signal duration of the selected phoneme unit to be the signal duration of the target phoneme unit, and then adjust the fundamental frequency and energy of the selected phoneme unit to be the fundamental frequency and energy of the target phoneme unit, respectively.

Thereafter, the speech synthesizer 150 generates a synthesized sound by synthesizing the phoneme units the prosody parameters of which are adjusted by the prosody adjuster 140. In particular, the speech synthesizer 150 may generate a high-quality synthesized sound by removing discontinuity between the phoneme units.

As described above, the plurality of phoneme units stored in the phoneme database 160 may be constructed in the form of voice waveforms or in the form of parameter sets. Hereinafter, a case where the phoneme units are constructed and stored in the form of voice waveforms will be described as a first embodiment, and a case where the phoneme units are constructed and stored in the form of parameter sets will be described as a second embodiment.

Figure 3:
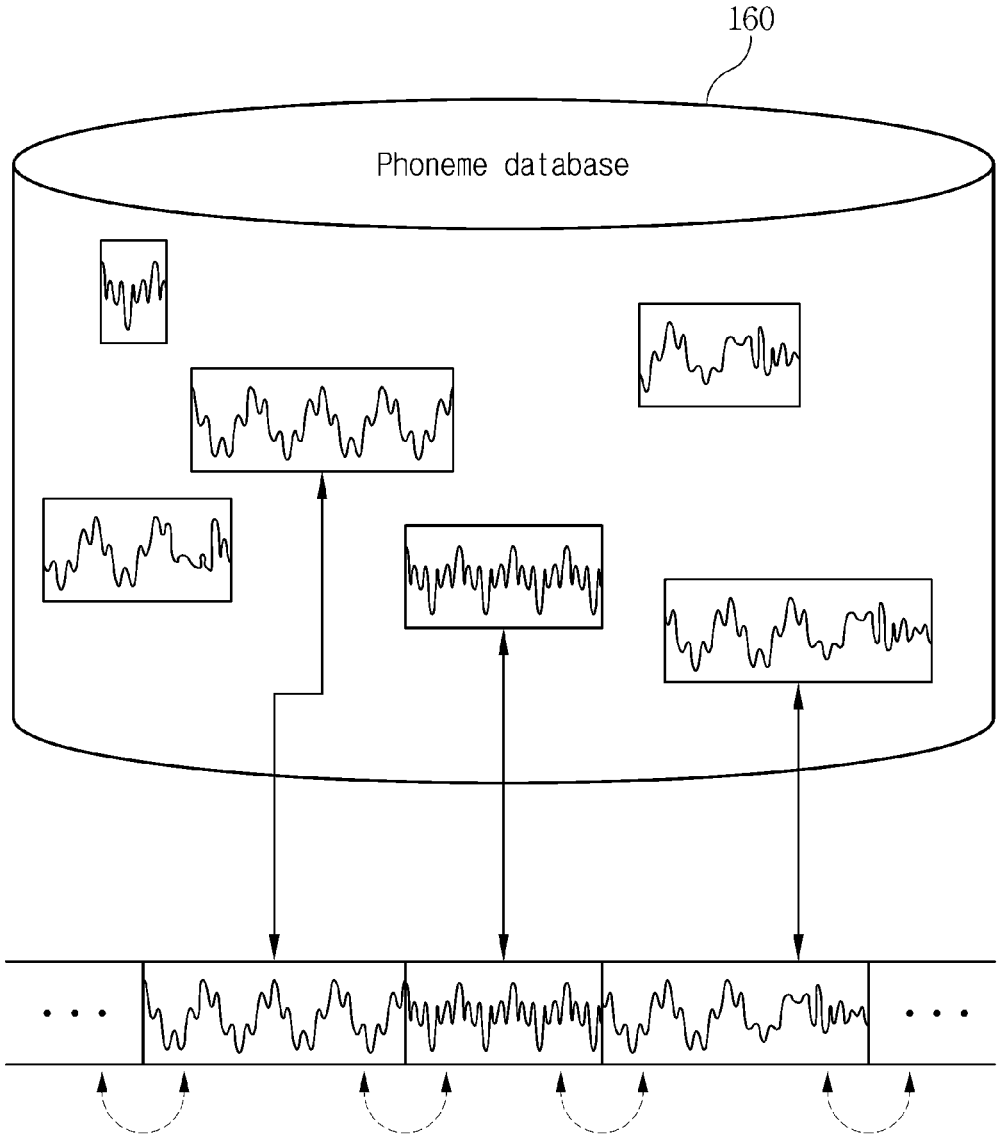
FIGS. 3 to 5 are exemplary diagrams illustrating a speech synthesis method according to a first embodiment of the present disclosure.
Figure 4:
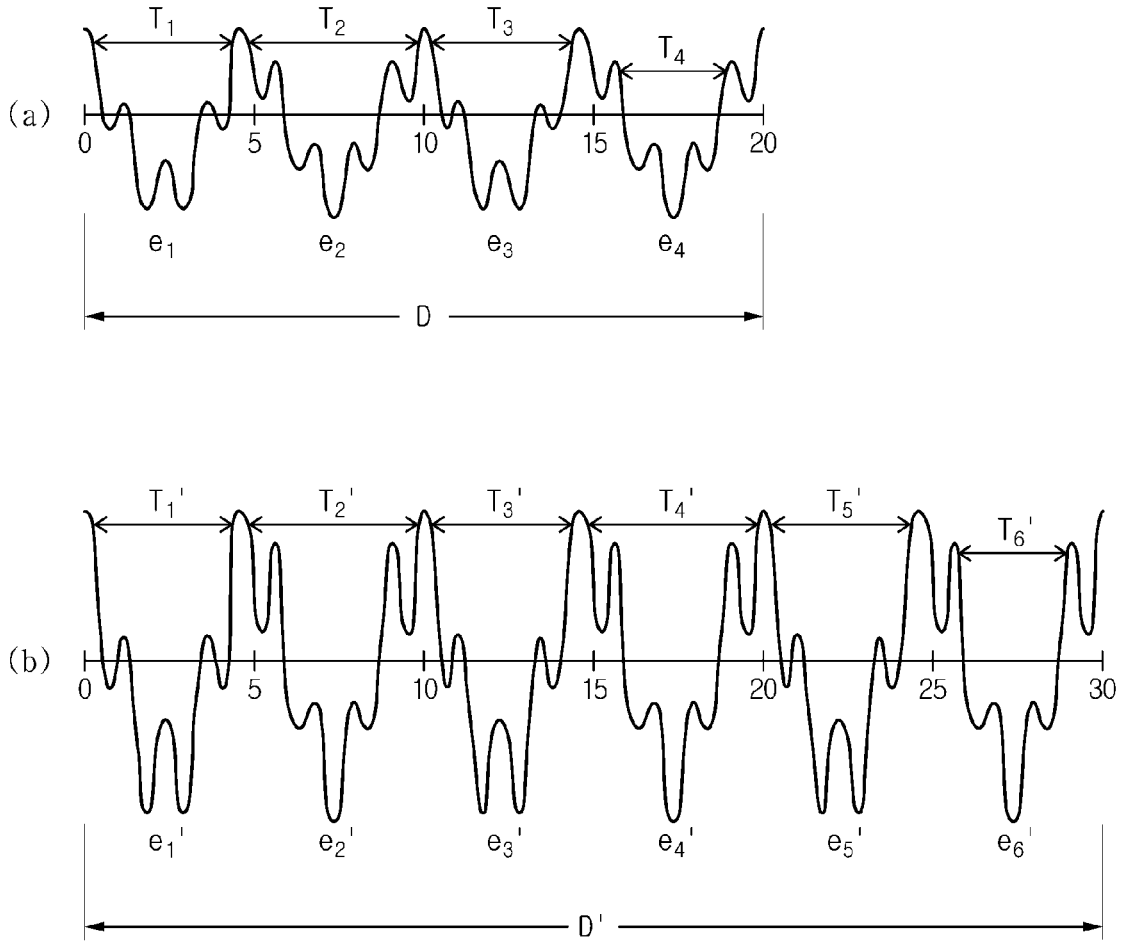
Figure 5:
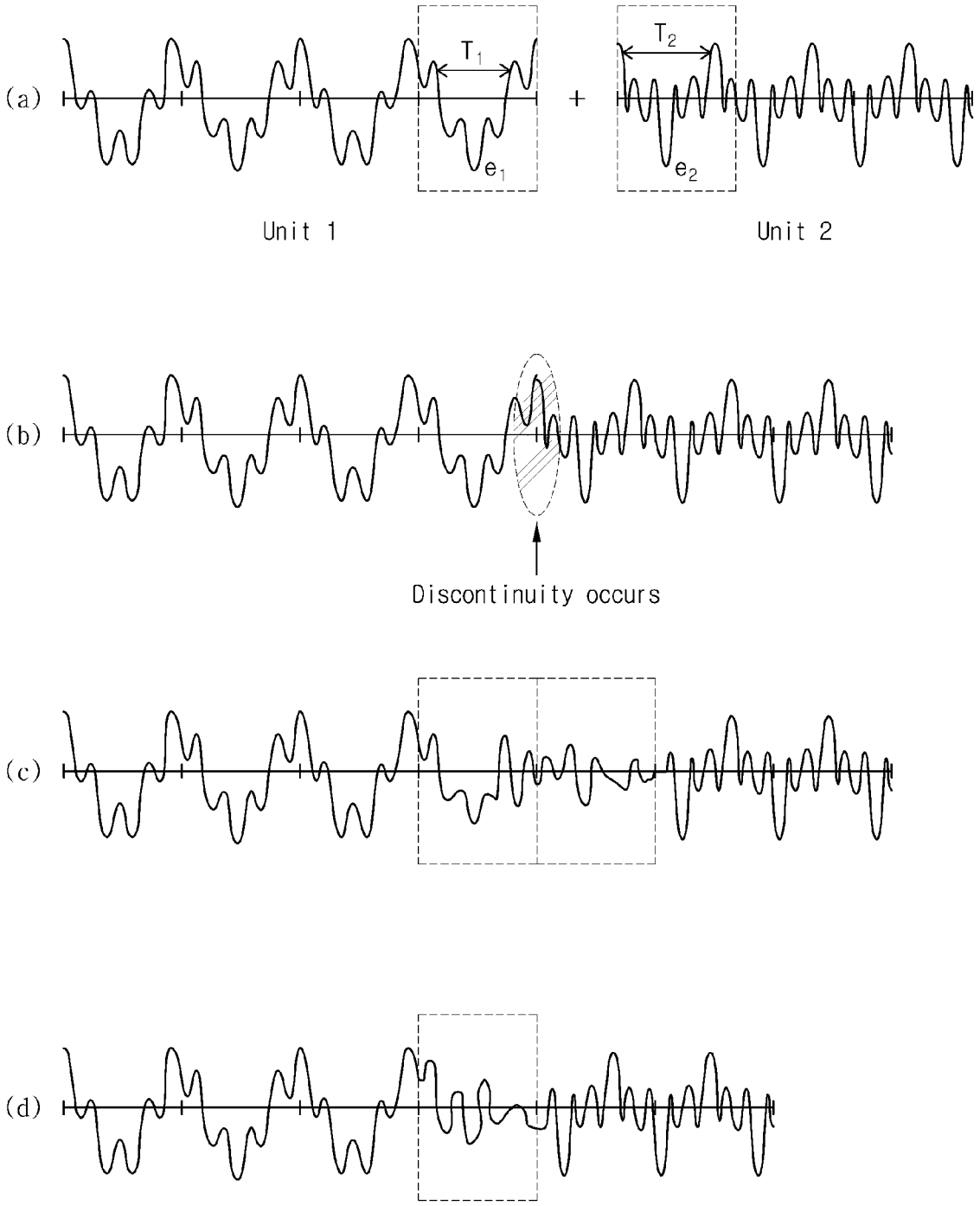

First, a speech synthesis method of the speech synthesis apparatus 100 according to the first embodiment of the present disclosure will be described with reference to FIGS. 3 to 5. FIGS. 3 to 5 are exemplary diagrams illustrating the speech synthesis method according to the first embodiment of the present disclosure.

As shown in FIG. 3, the speech synthesis apparatus 100 according to the first embodiment includes the phoneme database 160 that stores a plurality of phoneme units in the form of voice waveforms. These phoneme units may include one or more candidate units per phoneme.

As described above with reference to FIG. 2, when the unit selector 130 selects a specific phoneme unit from the phoneme database 160, the prosody adjuster 140 adjusts the prosody parameter of the selected phoneme unit to be the target prosody parameter of the target phoneme unit, and the speech synthesizer 150 synthesizes the phoneme units having the adjusted prosody parameters and thereby generates a synthesized sound. Particularly, the speech synthesizer 150 may generate a natural high-quality synthesized sound by removing the discontinuity occurring at a boundary between the phoneme units.

Now, this process will be described in more detail.

In FIG. 4, (a) shows one phoneme unit selected (or extracted) by the unit selector 130. The illustrated phoneme unit has a signal duration (D) of 20 ms in which four frames are continuous in a frame unit of 5 ms. In addition, the phoneme unit has energies (e1, e2, e3, e4) and fundamental frequencies (T1, T2, T3, T4) corresponding to the respective frames. The fundamental frequency may be referred to as a pitch or a fundamental frequency (F0).

In FIG. 4, (b) shows one target phoneme unit predicted by the prosody processor 120. The illustrated target phoneme unit has a signal duration (D') of 30 ms in which six frames are continuous in a frame unit of 5 ms. In addition, the target phoneme unit has energies (e1'~e6') and fundamental frequencies (T1'~T6') corresponding to the respective frames.

The prosody adjuster 140 performs a process of changing prosody parameters such that the voice-waveform phoneme unit extracted by the unit selector 130 becomes the target phoneme unit corresponding to prosody information extracted based on an inputted text. In this process, the prosody adjuster 140 first adjusts the signal duration and then adjusts the fundamental frequency and energy, respectively. For example, when the signal duration (D) of the phoneme unit extracted by the unit selector 130 is 20 ms and when the signal duration (D') of the target phoneme unit is 30 ms, the signal duration (D) of the extracted phoneme unit is adjusted from 20 ms to 30 ms. Adjusting the signal duration may be performed through frame copy or deletion. In the example of FIG. 4, the signal duration is increased by copying two frames. After the signal duration is adjusted, the energies (e1 to e4) and the fundamental frequencies (T1 to T4) for the respective frames of the extracted phoneme unit are adjusted to the energies (e1' to e6') and the fundamental frequencies (T1' to T6') of the target phoneme unit.

After adjusting the prosody parameters, the speech synthesizer 150 generates a synthesized sound by removing discontinuity between the phoneme units.

In FIG. 5, (a) shows two phoneme units (unit 1, unit 2). Hereinafter, the illustrated two phoneme units will be referred to as a previous phoneme unit (unit 1) and a next phoneme unit (unit 2).

As shown in (b) of FIG. 5, when the speech synthesizer 150 simply combines the previous phone unit and the next phone unit, discontinuity occurs at the boundary between the phone units, resulting in an unnatural synthesized sound.

In order to solve this problem, as shown in (c) of FIG. 5, the speech synthesizer 150 identifies the prosody parameters (fundamental frequency, energy) in each of the last frame of the previous phoneme unit and the start frame of the next phoneme unit, calculates an average value of the identified prosody parameters, and applies the calculated average value to each frame. For example, an average value of the fundamental frequency (T1) of the last frame of the previous phoneme unit and the fundamental frequency (T2) of the start frame of the next phoneme unit is calculated and applied to each of the last frame of the previous phoneme unit and the start frame of the next phoneme unit.

Alternatively, as shown in (d) of FIG. 5, the speech synthesizer 150 may overlap the last frame of the previous phoneme unit and the start frame of the next phoneme unit, and apply the above-discussed average value of the prosody parameters to the overlapped frames.

Through these steps, a more natural synthesized sound can be generated.

Next, a speech synthesis method of the speech synthesis apparatus 100 according to the second embodiment of the present disclosure will be described with reference to FIGS. 6 to 9. FIGS. 6 to 9 are exemplary diagrams illustrating the speech synthesis method according to the second embodiment of the present disclosure.

Figure 6:
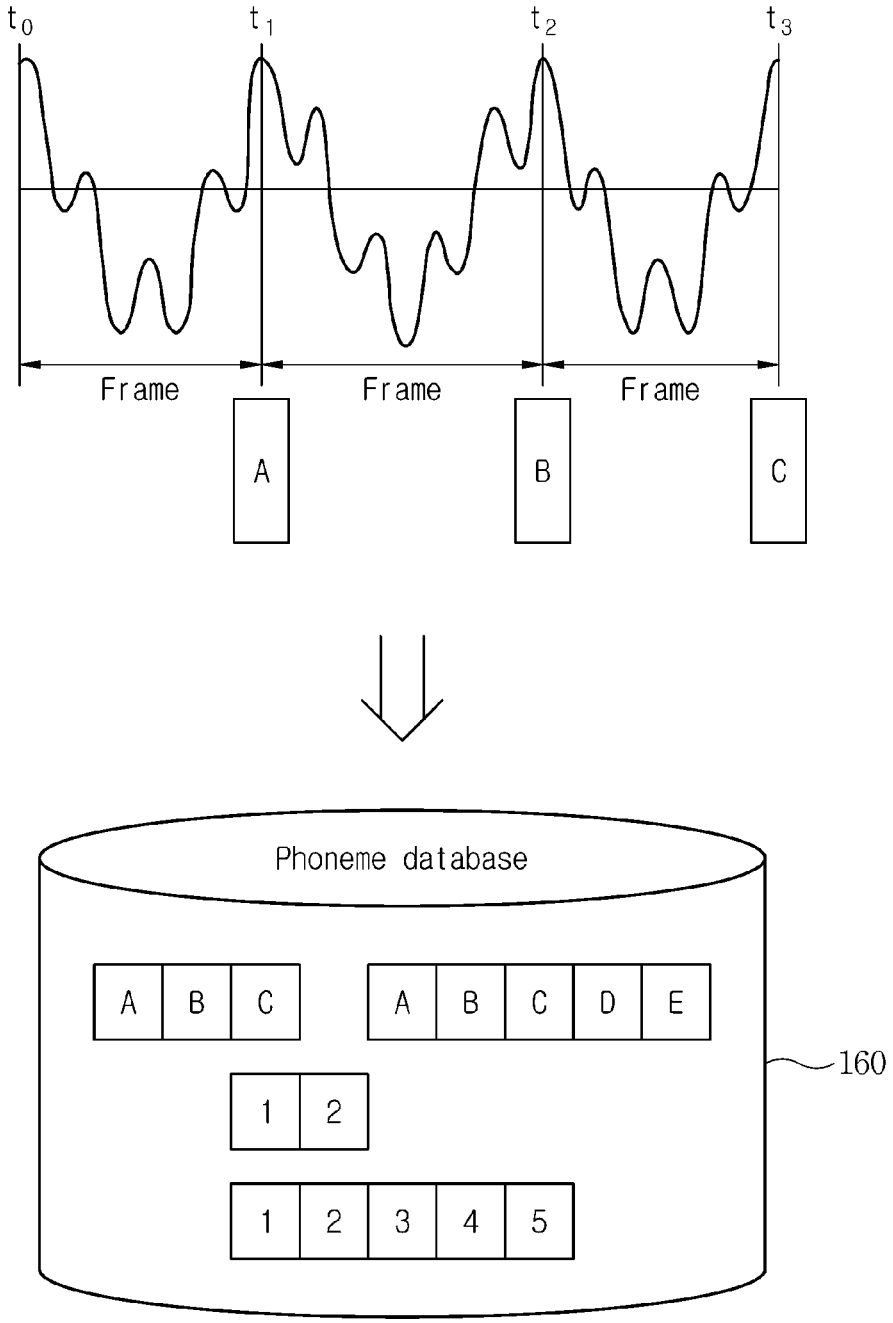
FIGS. 6 to 9 are exemplary diagrams illustrating a speech synthesis method according to a second embodiment of the present disclosure.

Referring to FIG. 6, the speech synthesis apparatus 100 according to the second embodiment includes the phoneme database 160 that stores a plurality of phoneme units in the form of parameter sets. In this case, the parameter set refers to a set of prosody parameters, and may mean a value modeled in the form of a vocoder for extracting prosody parameters according to a harmonic model.

Specifically, as shown in FIG. 6, when there is a voice waveform composed of three consecutive frames, prosody parameters extracted for each frame constitute one parameter set. In this case, the prosody parameters may include a fundamental frequency (F0) and an energy, and in some cases, may further include amplitude information and phase information which are used for energy calculation. The prosody parameters may be mapped to specific time points (t0, t1, t2, t3) of respective frames. Therefore, the number of elements (or the number of frame indexes) of the parameter set may correspond to the signal duration.

As described above with reference to FIG. 2, when the unit selector 130 selects a specific phoneme unit from the phoneme database 160, the prosody adjuster 140 adjusts the prosody parameter of the selected phoneme unit to be the target prosody parameter of the target phoneme unit, and the speech synthesizer 150 synthesizes the phoneme units having the adjusted prosody parameters and thereby generates a synthesized sound. Particularly, the speech synthesizer 150 may generate a natural high-quality synthesized sound by removing the discontinuity occurring at a boundary between the phoneme units.

Now, this process will be described in more detail.

Figure 7:
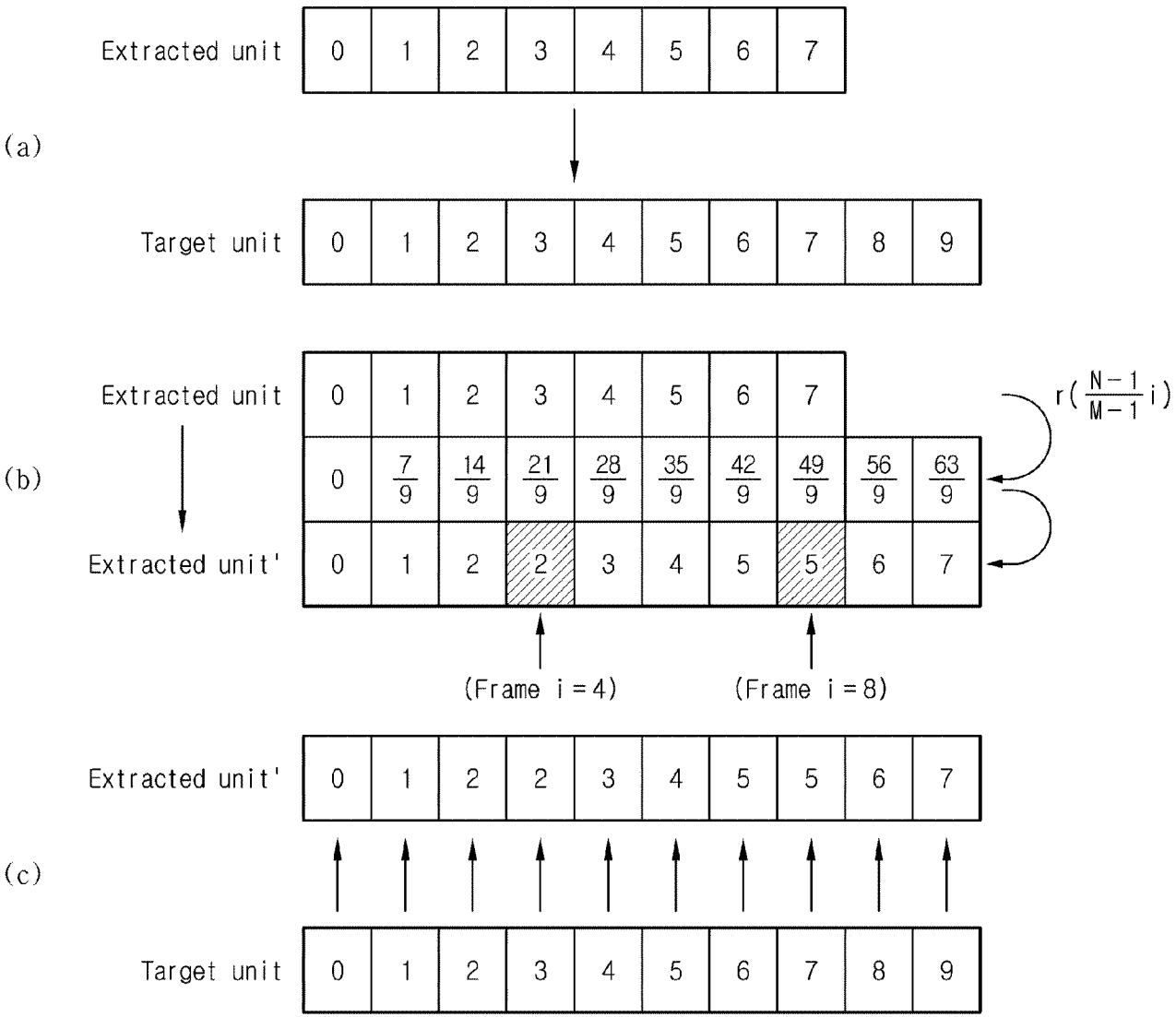

In FIG. 7, (a) shows one phoneme unit selected (or extracted) by the unit selector 130. The illustrated phoneme unit is composed of eight frames having frame indexes from 0 to 7. Each frame is, for example, of a 5 ms unit, and thus the total signal duration of the extracted phoneme unit is 40 ms.

In addition, (a) of FIG. 7 shows one target phoneme unit predicted by the prosody processor 120. The illustrated target phoneme unit is composed of ten frames having frame indexes from 0 to 9, and the total signal duration of the target phoneme unit composed of a 5 ms frame unit is 50 ms.

The prosody adjuster 140 adjusts the signal duration of the extracted phoneme unit to match the signal duration of the target phoneme unit. That is, because the signal duration of the extracted phoneme unit is 40 ms and the signal duration of the target phoneme unit is 50 ms in the above-described example, the signal duration may be adjusted by copying two frames corresponding to 10 ms.

To this end, the prosody adjuster 140 converts the frame indexes of the extracted phoneme unit into new frame indexes by using Equation 1 below.

$$r\left(\frac{N-1}{M-1}i\right) \quad \text{[Equation 1]}$$

In Equation 1, 'M' denotes the total number of frames of the target phoneme unit, and 'N' denotes the total number of frames of the extracted phoneme unit. Also, 'i' denotes a frame index of the extracted phoneme unit, and 'r' denotes a rounding-off operation.

As shown in (b) of FIG. 7, as a result of converting the frame indexes through Equation 1, the frame indexes 0, 1, 2, 3, 4, 5, 6, and 7 of the extracted phoneme unit are converted into new frame indexes 0, 1, 2, 2, 3, 4, 5, 5, 6, and 7. That is, frames 2 and 5 are added. This means copying and adding frames 2 and 5 among the frames of the extracted phoneme unit.

Therefore, as shown in (c) of FIG. 7, the extracted phoneme unit and the target phoneme unit have the same signal duration. Subsequently, the prosody adjuster 140 adjusts the prosody parameters of the extracted phoneme unit so that the parameter set of the target phoneme unit is applied to each frame unit. That is, the prosody adjuster 140 replaces the fundamental frequency of each frame of the extracted phoneme unit with the fundamental frequency of each frame of the target phoneme unit, and also adjusts amplitude to change the energy of each frame of the extracted phoneme unit to the energy of each frame of the target phoneme unit.

FIG. 7 shows an example where the signal duration of the target phoneme unit is greater than the signal duration of the extracted phoneme unit. In contrast, an example where the signal duration of the target phoneme unit is smaller than the signal duration of the extracted phoneme unit is shown in FIG. 8.

Figure 8:
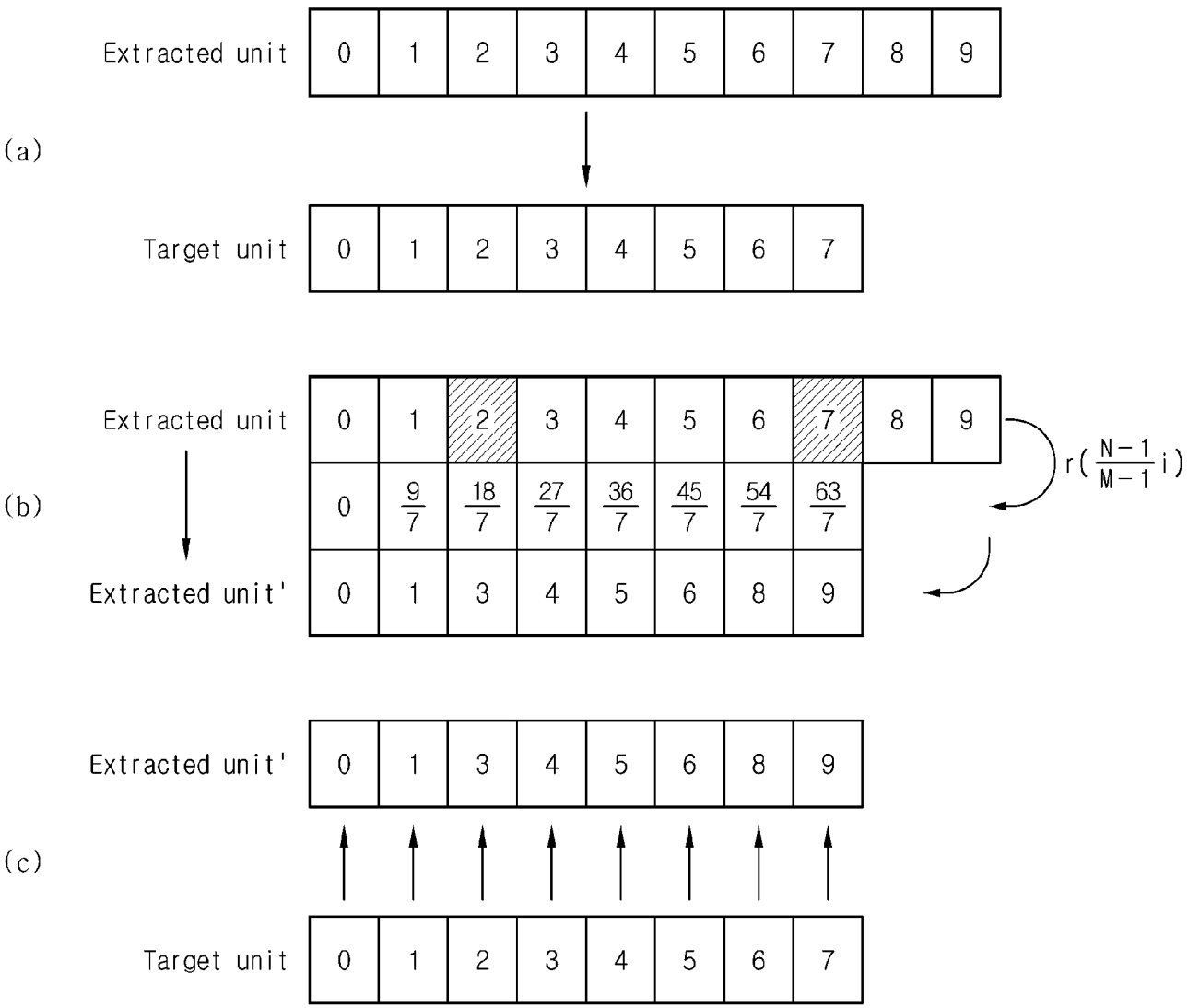

As shown in (a) of FIG. 8, it is assumed that one extracted phoneme unit is composed of ten frames and the corresponding target phoneme unit is composed of eight frames. In this case, because the target phoneme unit is shorter than the extracted phoneme unit, some of the frames of the extracted phoneme unit should be deleted.

Applying the above-mentioned Equation 1, the frame indexes 0, 1, 2, 3, 4, 5, 6, 7, 8, 9 of the extracted phoneme unit are converted into new frame indexes 0, 1, 3, 4, 5, 6, 8, and 9 as shown in (b) of FIG. 8. That is, frames 2 and 7 can be deleted.

Therefore, as shown in (c) of FIG. 8, the extracted phoneme unit and the target phoneme unit have the same signal duration. Subsequently, the prosody adjuster 140 adjusts the prosody parameters of the extracted phoneme unit so that the parameter set of the target phoneme unit is applied to each frame unit.

Thereafter, the speech synthesizer 150 generates a synthesized sound by removing discontinuity between phoneme units with prosody parameters adjusted. Now, this will be described with reference to FIG. 9.

Figure 9:
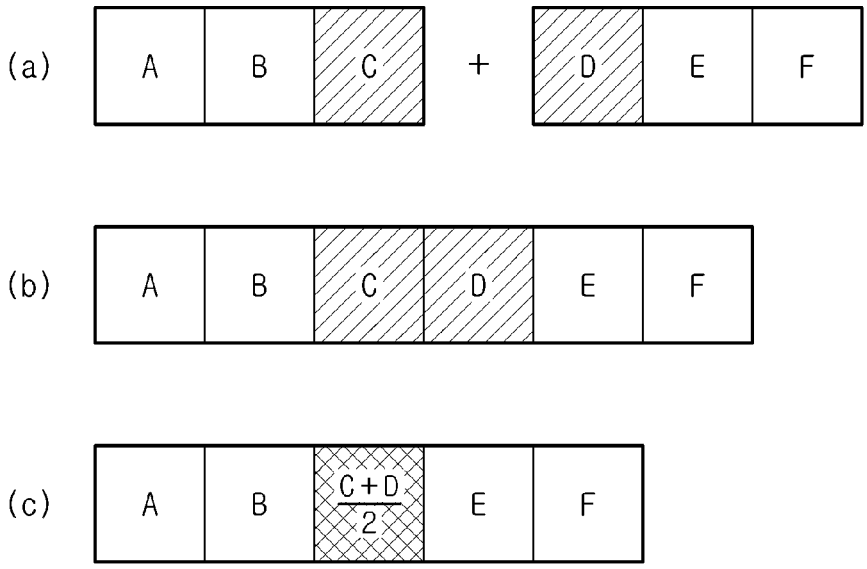

As shown in (a) of FIG. 9, it is assumed that there are a previous phoneme unit (unit 1) composed of three frames A, B, and C and a next phoneme unit (unit 2) composed of three frames D, E, and F. The speech synthesizer 150 combines the previous phoneme unit and the next phoneme unit to generate a synthesized sound.

In a first case, as shown in (b) of FIG. 9, the speech synthesizer 150 may apply a prosody parameter average value between the last frame C of the previous phoneme unit and the start frame D of the next phoneme unit to each of the frames C and D to generate a synthesized sound.

In a second case, as shown in (c) of FIG. 9, the speech synthesizer 150 may generate a new frame by overlapping the frames C and D and then apply the prosody parameter average value to this new frame to generate a synthesized sound.

The above-described operations of the speech synthesis apparatus 100 may be implemented or controlled by one or more processors equipped in the speech synthesis apparatus 100. This processor may be a single-threaded processor or a multi-threaded processor. In addition, the processor is capable of processing instructions stored in a memory or any other storage device.

Figure 10:
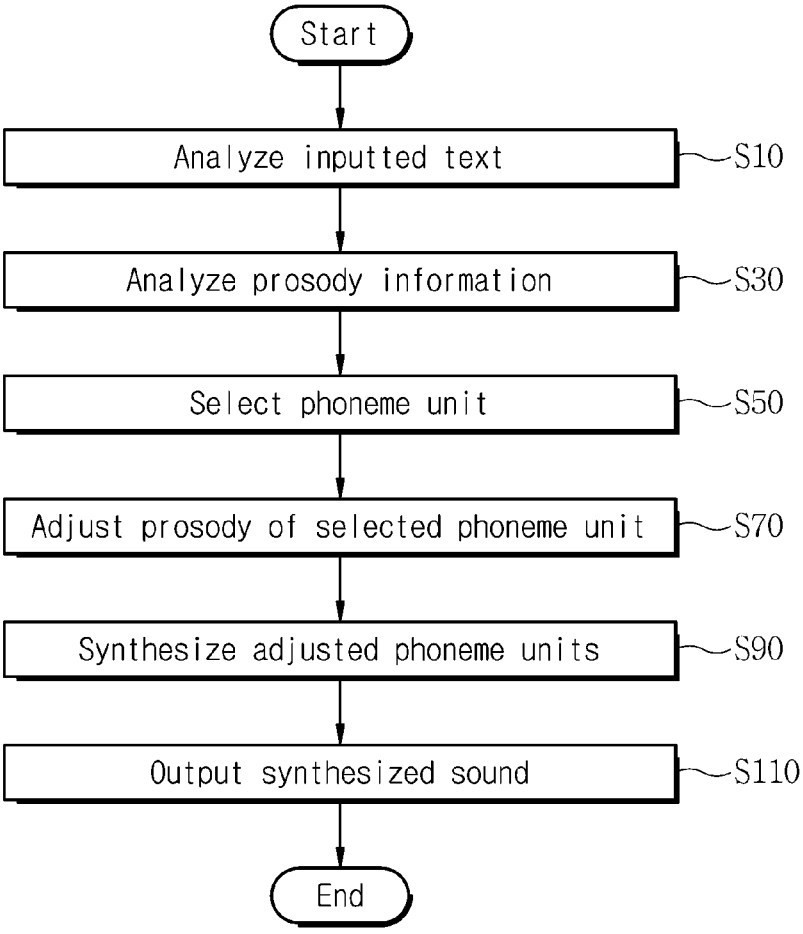
FIG. 10 is a flow diagram illustrating a speech synthesis method according to an embodiment of the present disclosure.

Now, a speech synthesis method according to an embodiment of the present disclosure will be described with reference to FIG. 10. FIG. 10 is a flow diagram illustrating the speech synthesis method according to an embodiment of the present disclosure. The speech synthesis method shown in FIG. 10 is performed by the speech synthesis apparatus 100 as described above.

First, when any text is inputted, the speech synthesis apparatus 100 performs language analysis and processing on the inputted text at step S10.

For example, the speech synthesis apparatus 100 may perform syntax analysis and morpheme analysis on the inputted text and thereby obtain information on a sentence structure and a sentence type. In addition, the speech synthesis apparatus 100 may translate a letter of a language other than a specific language, contained in the sentence, into a letter of the specific language, and also predict an actual pronunciation of the inputted text.

Next, at step S30, the speech synthesis apparatus 100 analyzes and processes prosody information on the inputted text. For example, the speech synthesis apparatus 100 may analyze the prosody information such as intonation and accent according to the sentence structure and type, such as determining a part to be read with a pause in a sentence, a part to be read strongly, and a tone of a sentence ending. In addition, the speech synthesis apparatus 100 may determine a target phoneme unit predicted based on the analyzed prosody information, and predict a prosody parameter (i.e., a target prosody parameter) of the determined target phoneme unit.

Next, at step S50, the speech synthesis apparatus 100 selects a specific phoneme unit from among one or more candidate units per phoneme stored in the phoneme database 160, based on the analyzed prosody information. That is, the phoneme database 160 of the speech synthesis apparatus 100 may store several candidate units for each phoneme, and the speech synthesis apparatus 100 may select (i.e., extract), based on the analyzed prosody information, a suitable phoneme unit from among the stored candidate units for each phoneme.

Next, at step S70, the speech synthesis apparatus 100 adjusts a prosody of the selected specific phoneme unit. That is, the speech synthesis apparatus 100 adjusts a prosody parameter of the specific phoneme unit selected at the step S50 to be the target prosody parameter of the target phoneme unit predicted at the step S30. As mentioned above, the prosody parameter is a fundamental frequency, an energy, a signal duration, and/or the like. In particular, the speech synthesis apparatus 100 may adjust the signal duration of the selected phoneme unit to be the signal duration of the target phoneme unit, and then adjust the fundamental frequency and energy of the selected phoneme unit to be the fundamental frequency and energy of the target phoneme unit, respectively.

Next, at step S90, the speech synthesis apparatus 100 generates a synthesized sound by synthesizing the phoneme units having the prosody parameters adjusted at the step S70. In particular, at this step, the speech synthesis apparatus 100 generates a high-quality synthesized sound by removing discontinuity between the phoneme units. Specifically, the speech synthesis apparatus 100 may identify the prosody parameters in each of the last frame of the previous phoneme unit and the start frame of the next phoneme unit from among the specific phoneme units having the adjusted prosody parameters, calculate an average value of the identified prosody parameters, and then apply the calculated average value to each of the last frame of the previous phoneme unit and the start frame of the next phoneme unit in order to remove the discontinuity. Alternatively, the calculated average value may be applied to a frame produced by overlapping the last frame of the previous phoneme unit and the start frame of the next phoneme unit.

Thereafter, at step S110, the speech synthesis apparatus 100 outputs the generated synthesized sound. When the speech synthesis apparatus 100 is implemented in the form of a module in a user terminal such as a smart phone, the speech synthesis apparatus 100 may transmit the synthesized sound to a speaker of the user terminal to output the synthesized sound through the speaker. When the speech synthesis apparatus 100 is implemented in a server, the speech synthesis apparatus 100 may transmit the synthesized sound to the user terminal through a communication network.

Hereinbefore, the speech synthesis apparatus and method according to embodiments of the present disclosure have been described.

The speech synthesis method according to embodiments of the present disclosure can be executed by a program recorded on a non-transitory computer-readable recording medium.

The non-transitory computer-readable recording medium may include program instructions, data files, data structures, etc. alone or in combination, and includes all kinds of recording devices in which data that can be read by a computer system is stored. The computer-readable recording medium includes magnetic media such as a hard disk, a floppy disk, and a magnetic tape, optical media such as a compact disc read only memory (CD-ROM) and a digital versatile disc (DVD), magneto-optical media such as a floptical disk, and semiconductor memories such as a read only memory (ROM), a random access memory (RAM), and a flash memory.

Further, the computer-readable recording medium may be distributed over networked computer systems so that computer-readable code can be stored and executed in a distributed fashion. In addition, functional programs, associated codes, and code segments for implementing the present disclosure may be easily deduced or altered by programmers in the art to which the present disclosure belongs.

Embodiments of the present disclosure disclosed in the specification and the drawings are only specific examples to easily explain the technical contents of the present disclosure and aid the understanding of the present disclosure, and are not intended to limit the scope of the present disclosure. It will be apparent to those skilled in the art that other modifications based on the technical idea of the present disclosure can be carried out in addition to the embodiments disclosed herein.

The present disclosure relates to the speech synthesis apparatus and method for outputting a text input as a speech. The speech synthesis apparatus and method can realize natural utterances by removing discontinuity between phoneme units when generating a synthesized sound from phoneme units, and also can generate a high-quality synthesized sound having a stable prosody. The speech synthesis apparatus and method according to the present disclosure can remove discontinuity between phoneme units, which is a problem of the typical USS method, and also can generate a more stable and high-quality synthesized sound than the typical SPS method. Therefore, speech synthesis technique according to the present disclosure has sufficient industrial applicability.

What is claimed is:

1. A speech synthesis apparatus comprising:

a phoneme database storing a plurality of phoneme units including one or more candidate units per phoneme;

a prosody processor analyzing prosody information on an inputted text and thereby predicting a target prosody parameter of a target phoneme unit;

a unit selector selecting a specific phoneme unit from among the one or more candidate units per phoneme stored in the phoneme database, based on the prosody information analyzed by the prosody processor;

a prosody adjuster adjusting a prosody parameter of the specific phoneme unit selected by the unit selector to be the target prosody parameter of the target phoneme unit predicted by the prosody processor; and a speech synthesizer generating a synthesized sound by removing discontinuity between the specific phoneme units each having the prosody parameter adjusted by the prosody adjuster, wherein the speech synthesizer identifies a prosody parameter of a last frame of a previous phoneme unit and a prosody parameter of a start frame of a next phoneme unit from among the specific phoneme units having the prosody parameters adjusted by the prosody adjuster, calculates an average value of the identified prosody parameters, and removes the discontinuity by applying the calculated average value to each of the last frame and the start frame or by applying the calculated average value to a frame produced by overlapping the last frame and the start frame.

2. The apparatus of claim 1, wherein the plurality of phoneme units stored in the phoneme database are constructed in a form of voice waveforms or in a form of parameter sets.

3. The apparatus of claim 1, wherein the prosody parameter includes at least one of a fundamental frequency, an energy, or a signal duration.

4. The apparatus of claim 1, wherein the prosody adjuster adjusts a signal duration of the selected phoneme unit to be a signal duration of the target phoneme unit, and then adjusts a fundamental frequency and energy of the selected phoneme unit to be a fundamental frequency and energy of the target phoneme unit, respectively.

5. The apparatus of claim 4, wherein the prosody adjuster copies or deletes at least one of a plurality of frames constituting the selected phoneme unit such that the signal duration of the selected phoneme unit is the signal duration of the target phoneme unit.

6. The apparatus of claim 4, wherein the prosody adjuster converts frame indexes of the selected phoneme unit into new frame indexes by using Equation below, and $$r\left(\frac{N-1}{M-1}i\right)$$

(in the above Equation, 'M' denotes the total number of frames of the target phoneme unit, 'N' denotes the total number of frames of the selected phoneme unit, 'i' denotes a frame index of the selected phoneme unit, and 'r' denotes a rounding-off operation)

adjusts the signal duration of the selected phoneme unit to be the signal duration of the target phoneme unit by copying or deleting at least one of a plurality of frames constituting the selected phoneme unit in accordance with the new frame indexes.

7. A speech synthesis method performed by a speech synthesis apparatus including a phoneme database storing a plurality of phoneme units including one or more candidate units per phoneme, the method comprising:

analyzing prosody information on an inputted text to thereby predict a target prosody parameter of a target phoneme unit;

selecting a specific phoneme unit from among the one or more candidate units per phoneme stored in the phoneme database, based on the analyzed prosody information;

adjusting a prosody parameter of the selected specific phoneme unit to be the target prosody parameter of the target phoneme unit; and generating a synthesized sound by removing discontinuity between the specific phoneme units each having the adjusted prosody parameter, wherein the generating includes:

identifying a prosody parameter of a last frame of a previous phoneme unit and a prosody parameter of a start frame of a next phoneme unit from among the specific phoneme units having the adjusted prosody parameters;

calculating an average value of the identified prosody parameters; and removing the discontinuity by applying the calculated average value to each of the last frame and the start frame or by applying the calculated average value to a frame produced by overlapping the last frame and the start frame.

8. The method of claim 7, wherein the adjusting includes: adjusting a signal duration of the selected phoneme unit to be a signal duration of the target phoneme unit; and then adjusting a fundamental frequency and energy of the selected phoneme unit to be a fundamental frequency and energy of the target phoneme unit, respectively.

9. The method of claim 8, wherein the adjusting includes:

copying or deleting at least one of a plurality of frames constituting the selected phoneme unit such that the signal duration of the selected phoneme unit is the signal duration of the target phoneme unit.

10. The method of claim 8, wherein the adjusting includes:

converting frame indexes of the selected phoneme unit into new frame indexes by using Equation below, and $$r\left(\frac{N-1}{M-1}i\right)$$

(in the above Equation, 'M' denotes the total number of frames of the target phoneme unit, 'N' denotes the total number of frames of the selected phoneme unit, 'i' denotes a frame index of the selected phoneme unit, and 'r' denotes a rounding-off operation)

adjusting the signal duration of the selected phoneme unit to be the signal duration of the target phoneme unit by copying or deleting at least one of a plurality of frames constituting the selected phoneme unit in accordance with the new frame indexes.

11. A non-transitory computer-readable recording medium storing a program for executing a speech synthesis method performed by a speech synthesis apparatus including a phoneme database storing a plurality of phoneme units including one or more candidate units per phoneme, the method comprising:

analyzing prosody information on an inputted text to thereby predict a target prosody parameter of a target phoneme unit;

selecting a specific phoneme unit from among the one or more candidate units per phoneme stored in the phoneme database, based on the analyzed prosody information;

adjusting a prosody parameter of the selected specific phoneme unit to be the target prosody parameter of the target phoneme unit; and generating a synthesized sound by removing discontinuity between the specific phoneme units each having the adjusted prosody parameter, wherein the generating includes:

identifying a prosody parameter of a last frame of a previous phoneme unit and a prosody parameter of a start frame of a next phoneme unit from among the specific phoneme units having the adjusted prosody parameters;

calculating an average value of the identified prosody parameters; and removing the discontinuity by applying the calculated average value to each of the last frame and the start frame or by applying the calculated average value to a frame produced by overlapping the last frame and the start frame.

* * * * *